United States Patent [19]

Gerhardy

[11] 4,336,208

[45] Jun. 22, 1982

[54] CARBURETOR FOR INTERNAL COMBUSTION ENGINE

[75] Inventor: Reinhard Gerhardy, Korb, Fed. Rep. of Germany

[73] Assignee: Andreas Stihl, Waiblingen, Fed. Rep. of Germany

[21] Appl. No.: 234,185

[22] Filed: Feb. 13, 1981

[30] Foreign Application Priority Data

Feb. 16, 1980 [DE] Fed. Rep. of Germany ..... 3005854

[51] Int. Cl.[3] ..... F02M 3/08

[52] U.S. Cl. ..... 261/71; 261/DIG. 38; 411/303

[58] Field of Search ..... 261/DIG. 38, 71; 411/301, 302, 303, 304, 314

[56] References Cited

U.S. PATENT DOCUMENTS

| | | | |
|---|---|---|---|
| 298,843 | 5/1884 | Gissinger | 411/304 |
| 362,909 | 5/1887 | Tucker | 411/303 |
| 2,204,385 | 6/1940 | Schmidt et al. | 411/303 |
| 2,400,444 | 5/1946 | Taylor et al. | 411/302 |
| 2,506,477 | 5/1950 | Warren, Jr. | 411/301 |
| 2,618,473 | 11/1952 | Whitford | 261/DIG. 38 |
| 2,763,313 | 9/1956 | Bydalek | 411/301 |
| 3,425,672 | 2/1969 | Seigel et al. | 261/DIG. 38 |
| 3,454,264 | 7/1969 | Sarto | 261/DIG. 38 |
| 3,992,490 | 11/1976 | Preston | 261/DIG. 38 |
| 4,246,929 | 1/1981 | Wakeman | 261/DIG. 38 |

FOREIGN PATENT DOCUMENTS

| | | | |
|---|---|---|---|
| 2245042 | 3/1974 | Fed. Rep. of Germany | 411/301 |
| 566232 | 12/1944 | United Kingdom | 411/302 |

*Primary Examiner*—Tim R. Miles

*Attorney, Agent, or Firm*—Becker & Becker, Inc.

[57] ABSTRACT

A carburetor for an internal combustion engine in a power saw. The carburetor has at least one adjustment screw which is fastened and secured in a bore of a receiving part on the carburetor housing or on the internal combustion engine. A shim or clamping piece, which is secured against rotation, is arranged in a recess of the receiving part. The clamping piece receives the adjustment screw in a positive, locking manner. The clamping piece has projections with which the clamping piece is held locked in the recess of the receiving part.

12 Claims, 12 Drawing Figures

CARBURETOR FOR INTERNAL COMBUSTION ENGINE

The present invention relates to a carburetor, for an internal combustion engine in a power saw, having at least one adjustment screw that is fastened and secured in a bore of a receiving part on the carburetor housing or on the internal combustion engine.

Screws provided with carburetors for adjustment are secured against an automatic shift or displacement. This securing or retention comprises a pressure or compression spring which is arranged between the screw head and the holding element of the screw. This pressure spring effects an increase of the frictional engagement in the thread, so that a displacement or shifting is more difficult. In practice, however, it has been found that the value set or adjusted in the carburetor changes by way of the screw, particularly by way of the vibrations prevailing on the power saw, in that the screw subsequently shifts or moves out of adjustment. As a consequence of the continuous vibrations of the power saw, and hence of the carburetor, fatigue phenomena inevitably arise at the pressure spring, as a result of which the adjustment screw receives a play in the receiving thread. This has as a consequence that the function of the carburetor is affected by the now oscillating adjustment screws.

A torsional or rotary tension is also introduced into the pressure spring by a displacement of the adjustment screw in a nominal range; consequently, the pressure spring has a tendency to rotate back into its starting position. When the vibrations from the motor and the rotational or torsional tension of the pressure spring occur at the same time, as is the case during adjustment of a running motor, a shifting or displacement of the adjustment screw can result already directly after engagement with the adjustment tool.

Furthermore, it is known to secure an adjustment screw, against an automatic displacement or shifting, by means of a ball of synthetic material. This synthetic material ball is arranged radially with respect to the screw in such a manner that it presses into the thread of the screw. The maintenance of tolerances for attaining a self locking or binding is only insufficiently attainable with this type of securing or retention. Also, the self locking is eliminated after several adjustment procedures, and such elimination is accelerated still further by the vibrations of the motor.

Furthermore, with parts made of synthetic material, it is known to arrange the adjustment screws directly in the synthetic material part in such a manner that these adjustment screws themselves cut a thread in the synthetic material in a self-threading manner. Consequently, such a friction is generated that the screw has a certain self-locking action. Such an arrangement of the adjustment screw in a synthetic material part is usable only under such circumstances where the adjustment screw is arranged directly on the carburetor and where a synthetic material part can be provided. For example, a synthetic material cover, for complete and accurate sealing, as is necessary for example with a carburetor, must be fastened with several screws, while a die-cast cover of light metal can be securely and tightly fastened with only a screw.

It is therefore an object of the present invention to provide a securing or retention for adjustment screws on a carburetor in such a manner that an automatic post displacement is prevented, and additionally makes possible an accurate adjustment without post displacement.

This object, and other objects and advantages of the present invention, will appear more clearly from the following specification in connection with the accompanying drawings, in which.

Figure 1:
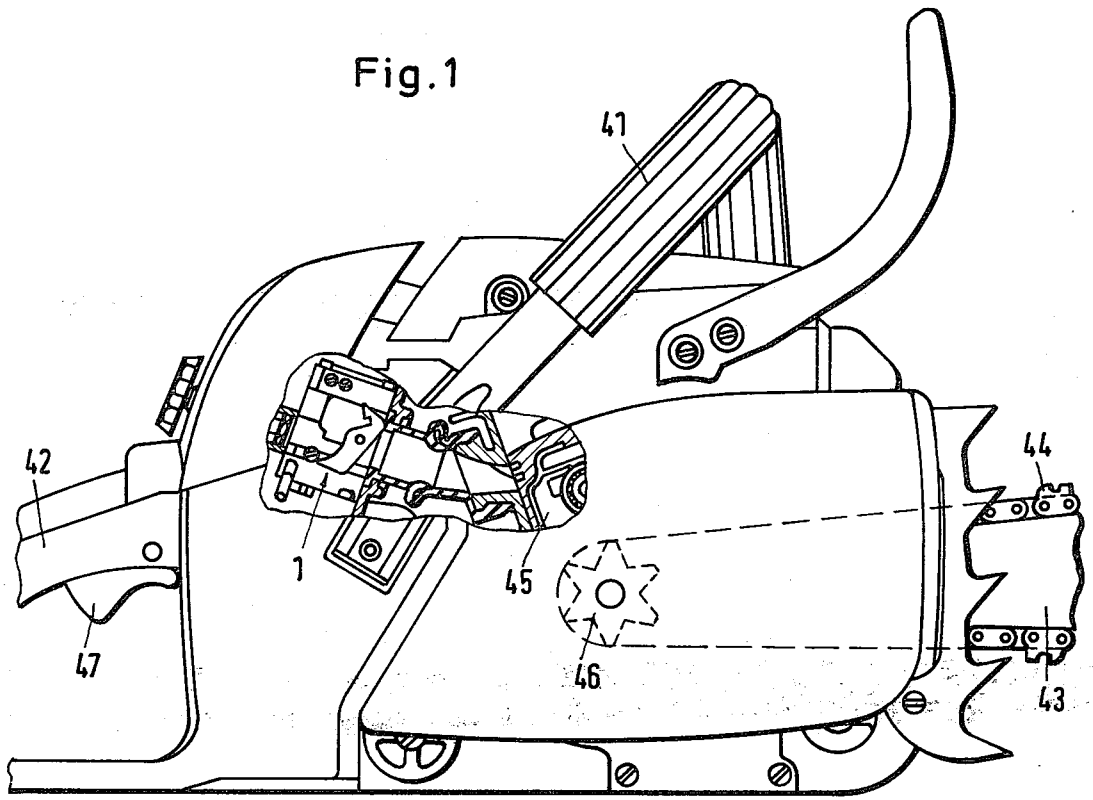
FIG. 1 is a partially sectioned illustration of a power chain saw with a carburetor in accordance with the present invention.

The carburetor of the present invention is characterized primarily by a shim, wedge, or clamping piece which is arranged in a recess of the receiving part, is secured against rotation, and receives the adjustment screw in a positive, locking manner.

According to further advantageous features of the present invention, the shim or clamping piece may be provided with holding means with which the clamping piece is held in the recess of the receiving part under locking action. The shim or clamping piece, which is made of an elastic material, may be provided with bores, which are free of threads and have a smaller diameter than the diameter of the adjustment screws, to make it possible to receive one or more adjustment screws in the bores in a positive locking manner.

The holding means of the clamping piece may comprise projections for a snug fit in the recess, and these projections may be arranged on the surfaces as well as on the edges of the clamping piece. The clamping piece may be held in the recess by an adhesive connection. The recess may comprise a pocket in a fork-like receiving part of the carburetor, with the pocket being arranged between legs of the receiving part and receiving the clamping piece; the adjustment screw is held in a threaded bore in each of the legs, whereby the pocket is preferably closed on five sides. The projections may be distributed over the surfaces of the clamping piece. The projections may be knobs having a hemispherical shape, and may respectively be located so as to be equally spaced from the bore 13 of the clamping piece. The knobs may be respectively arranged symmetrical to the axes of the bore. The projections on the edges of the clamping piece may be embodied as nose-shaped beads and may have a semi-circular end edge. The beads may extend on all sides of the clamping piece, and may respectively extend symmetrical to the middle axes of the clamping piece. The beads may have a thickness d which is smaller than the thickness D of the clamping piece. An area of reduced material thickness may be provided between two clamping pieces for attaining flexibility upon their connection adjacent to each other in a dual or double embodiment.

The advantages attained with the present invention essentially consist in that no automatic shift or displacement of the adjustment screws is possible either by vibrations or directly after an adjustment procedure. Additionally, several adjustment screws can be received by one clamping piece, so that pressure springs for each screw are needless. Of further advantage is the fact that the adjustment screw is supported in two legs of the receiving part, with the clamping piece being fixed between these two legs. Consequently, the adjustment screw is held in two threaded segments which are spaced from each other, as a result of which the thread in the receiving part of the carburetor is nominally stressed. If for structural reasons it is necessary to make the adjustment screw rather long, the latter is supported in a mechanically more secure and in a forcefully more advantageous manner in two spaced apart threaded pieces than in a single threaded segment, so that, for example, bending stresses of the screw are taken up more advantageously than with a single support. Moreover, it is no longer necessary that the adjustment screw must be screws with heads, since with a screw secured by a clamping piece, the need for a head embodied as a counter abutment surface for the securing or retaining spring is eliminated. Consequently, by utilizing the shim or clamping piece, screws can be used which are more advantageous as to mass, i.e., require less material cost, for example headless screws or setscrews.

Referring now to the drawings in detail, FIG. 1 shows a power chain saw with a front handle 41, a rear handle 42, and a saw tongue or guide bar 43 upon which a saw chain 44 rotates. A drive motor 45 is provided as an internal combustion engine for driving the saw chain; this motor 45 drives the saw chain 44 by way of a drive sprocket 46. A carburetor 1 is connected to the drive motor 45. A switch 47 is provided on the rear handle 42 for actuating the drive or operation of the saw chain 44.

Figure 2:
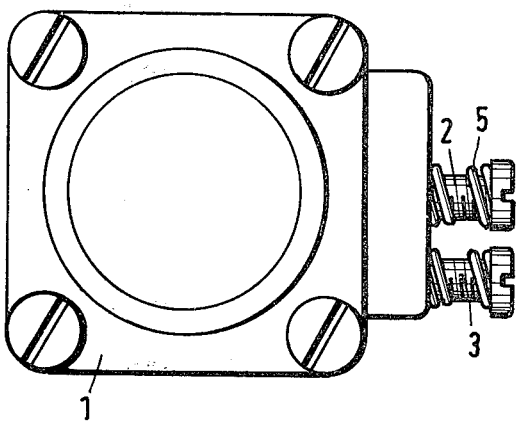
FIG. 2 is a view showing a carburetor having conventional retaining springs for the adjustment screws.
Figure 4:
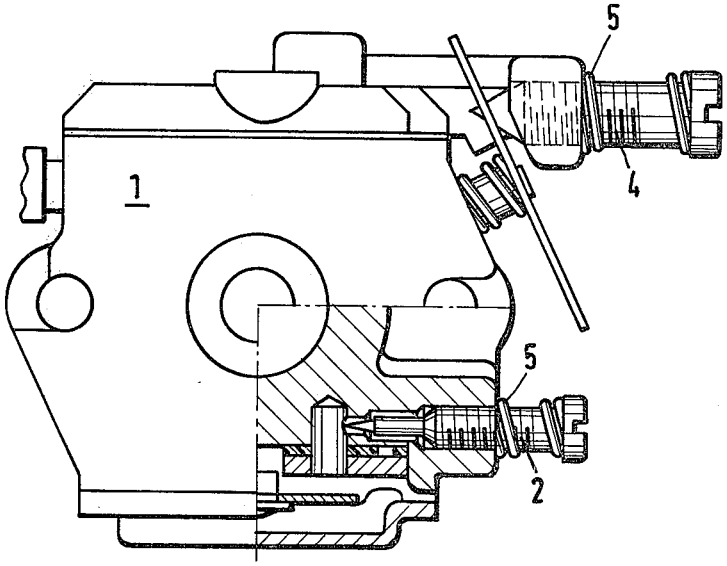
FIG. 4 is a side view of the carburetor in FIG. 2 having adjustment screws provided with conventional retaining springs.

The carburetor 1 has several adjustment screws 2,3,4 which are secured or retained in a conventional manner with pressure or compression springs 5 (FIGS. 2 and 4).

Figure 3:
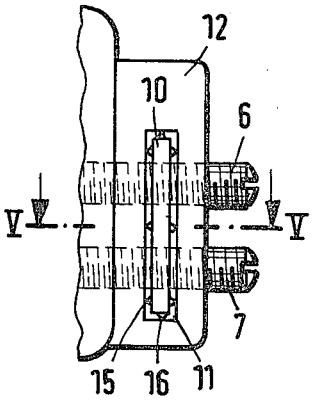
FIG. 3 is a fragmentary view similar to that of FIG. 2 showing adjustment screws arranged adjacent to each other and retained or secured in accordance with the teaching of the present invention.
Figure 6:
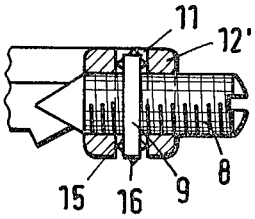
FIG. 6 is a sectioned view through a receiving part having a shim, wedge, or clamping piece for receiving an adjustment screw.

According to FIGS. 3 and 6, the securing of the adjustment screws 6,7 and 8 on the carburetor 1, which screws correspond to these adjustment screws 2,3,4, is effected inventively by one or more shims, wedges, or clamping pieces 9, 10. The wedging or clamping piece 9, 10 is held fixedly seated, i.e. fixed in position, in a recess 11 of a receiving part 12, 12' in the carburetor 1. This tight-fit arrangement of the clamping piece 9, 10 can be effected by appropriate embodiment of the clamping piece itself, for example in that the clamping piece 9, 10 engages, e.g. by substantially total-surface engagement, against the wall of the non-circular or out-of-round, approximately rectangular cross section of the recess 11 so as to be secure against rotation; the tight fit can also be effected by an adhesive connection, or by an appropriate embodiment of the recess, as for example with ribs, crosspieces, knobs, and the like. The tight fit can also be attained by holding elements, as for instance barbs and the like, which correspond to the clamping piece.

Figure 5:
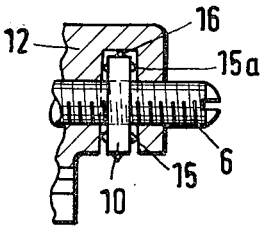
FIG. 5 is a section taken along line V—V in FIG. 3.

The recess 11 itself can be embodied as a pocket, a slot, or in a similar manner. As illustrated in more detail by FIGS. 3 and 5, or by FIGS. 7 and 8, the recess 11 is embodied as a pocket in which the shim or clamping piece 9, 10 is held fixed in position and with a tight fit. In this connection, the pocket 11, which is closed on five sides, can be arranged directly in the receiving part 12, which is made, for instance, of cast metal.

The clamping piece 9, 10 comprises a synthetic material, such as a thermally stable, heat resistant synthetic material, preferably a polyamide. In order to make possible a positive receiving of one or more adjustment screws 6, 7, 8, the clamping piece 9, 10 is provided with corresponding threadless bores 13 of a smaller diameter than the outer diameter of the adjustment screw.

The clamping piece 9, 10 is provided with holding means 14 in order to fit tightly in the recess 11. These holding means 14 comprise projections 15 and 16 which are arranged on the surfaces 17 and 18 as well as on the edges 19 of the clamping piece 9, 10. The projections on the surfaces 17 and 18 comprise knobs 15 which are distributed over the surfaces 17 and 18. These knobs 15 are in particular hemispherical. The knobs 15 can, however, also have a different shape. With the embodiment of FIG. 7, the pocket 11 is a three-sided slot which can be cast or machined.

Since oppositely located walls 20, 21, for instance of the recess 11 (FIG. 7), extend slightly conically toward the opening as a consequence of casting-technical reasons, the knobs 15 serve to equalize the taper and simultaneously to assure a snug fit by means of a clamping effect. So that an insertion of the clamping piece 9 into the recess 11 can occur without regard to the position thereof, the knobs 15 are arranged at an equal distance a from and symmetrically to, the axes 24 and 25 of the bore 13 in the clamping piece 9. As illustrated in greater detail in the sample embodiment according to FIGS. 7 and 8, the knobs **15*a* located near the recess bottom 26** exert the actual clamping effect, while the other more remote knobs participate to a lesser extent in the clamping effect, or are not involved at all.

By means of the knobs **15, 15*a*, there is also attained that the clamping piece 9 is supported at right angles to the adjustment screw longitudinal axis 27**.

Furthermore, the clamping pieces 9, 10, along their edges 19, likewise have projections which comprise nose-like beads 16. The termination or end can be embodied in a semi-circular shape, or can also be embodied in a smooth manner. These beads 16 are arranged substantially on all sides over the periphery of the clamping piece in the manner of strips. The corners of the clamping piece are respectively cut off, so that during setting, fitting, or truing into the recess 11, as shown in detail for instance by FIG. 7, the corners do not preclude engagement against the bottom 26 of the recess 11. According to a specific embodiment, the beads 16 respectively extend symmetrically to the middle axes of the clamping piece 9. These beads 16, which are located along the edges or sides, engage the end walls 20 and 21 of the recess 9 during insertion in the recess 9 (FIG. 7), and the bead 16 accordingly simultaneously effect a further clamping effect in addition to the clamping effect of the knobs 15. A secure fit or seating is hereby attained in the direction of rotation of the adjustment screws 6, 7, and 8, so that the clamping piece 9 cannot change its position during rotation of the adjustment screw.

Figure 8:
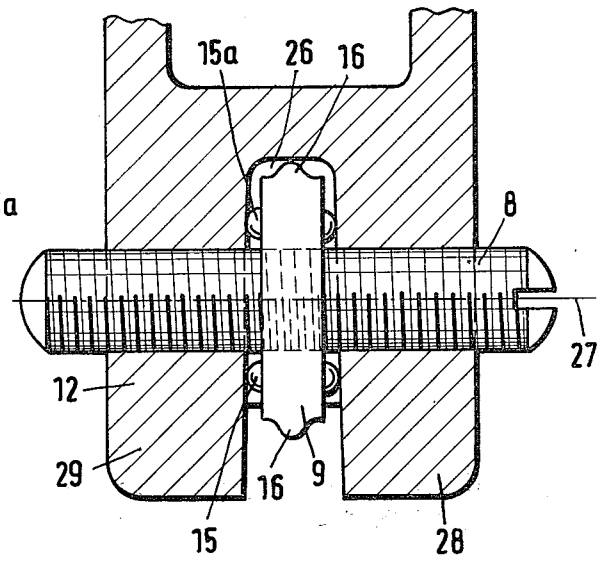
FIG. 8 is a fragmentary sectioned side view of the receiving part according to FIG. 7.
Figure 7:
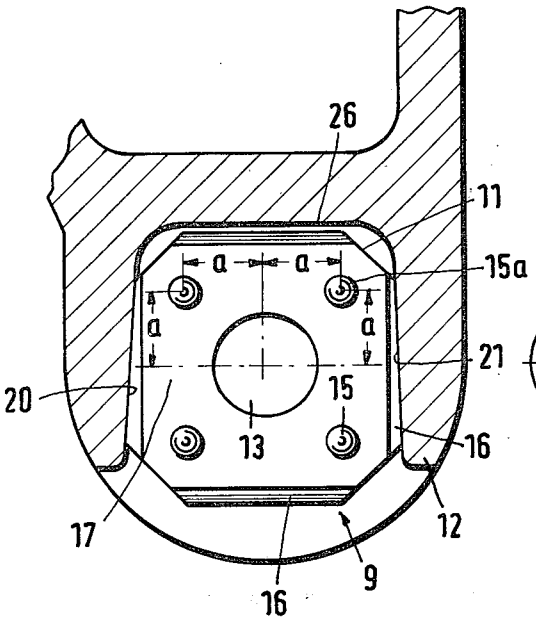
FIG. 7 is a fragmentary sectioned view of a further receiving part having a recess, embodied as a pocket, for a shim or clamping piece.

Utilization of the clamping piece 9 of synthetic material occurs as follows: the clamping piece 9 is pressed into the recess 11 on the carburetor, for instance into the pocket according to FIGS. 7 and 8, and is rigidly clamped or fixed by the knobs 15 and the beads 16. The adjustment screw 8 is turned as far as to the clamping piece in the one leg 28 of the receiving part 12. Since the clamping piece has a bore 13 of smaller diameter than the diameter of the adjustment screw 8, the adjustment screw 8 is self threading or cuts its own thread during further turning thereof. The screw 8, after penetrating the clamping piece 9, again engages the thread of the second leg 29 of the receiving part 12; the screw 8 is then set or adjusted in conformity with its function in the carburetor 1.

Figure 9:
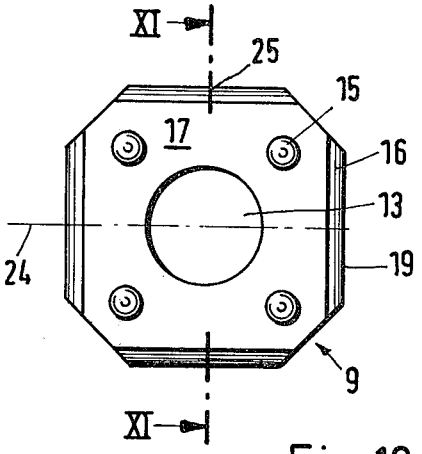
FIG. 9 is a front view of a shim or clamping piece.
Figure 11:
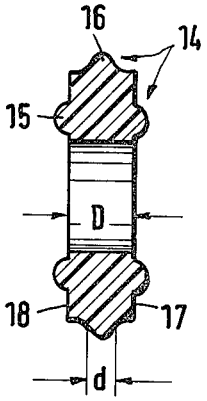
FIG. 11 is a section taken along line XI—XI in FIG. 9.
Figure 10:
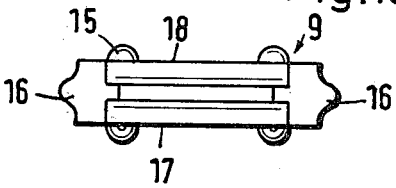
FIG. 10 is a top or plan view of the clamping piece of FIG. 9.
Figure 12:
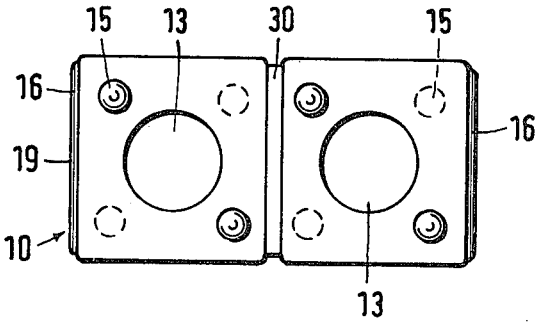
FIG. 12 is a top or plan view of the shim or clamping piece in a dual or double embodiment thereof.

According to FIGS. 3 and 12, the clamping piece 10 can also be embodied for two screws. Likewise, it would also be conceivable to secure a larger number of screws, if necessary, by a clamping piece having an appropriate configuration. Also, the arrangement and the number of knobs 15 can be varied in conformity with the given conditions. The embodiment with four knobs according to FIG. 9 represents only a sample embodiment.

With the dual embodiment or arrangement of the clamping piece according to FIG. 12, an area 30 of reduced material thickness is advantageously provided between the two clamping pieces. As a consequence of this area of reduced thickness, there results a flexible region by means of which a median-tolerance equalization is made possible in a simple manner.

The present invention is, of course, in no way restricted to the specific disclosure of the specification and drawings, but also encompasses any modifications within the scope of the appended claims.

What I claim is:

1. In combination with a receiving part located on one of a carburetor and an internal combustion engine of a power saw, said receiving part being provided with at least one bore for respectively having fastened and secured therein an adjustment screw; the improvement in which said receiving part is further provided with a recess, and which includes a clamping piece which is arranged in said recess in such a way as to be secure against rotation, said clamping piece receiving said adjustment screw in a positive, locking manner, said clamping piece being provided with holding means for securely holding said clamping piece in said recess of said receiving part, said clamping piece comprising flexible material and being provided with bores, which are free of threads and respectively have a smaller diameter than the diameter of the associated adjustment screw, in order to make it possible to receive respective adjustment screws in said bores in a positive locking manner, said holding means comprising projections arranged on the surfaces as well as on the edges of said clamping piece to provide a snug fit of said clamping piece in said recess.

2. A combination according to claim 1, in which said receiving part is a fork-like receiving part having two legs, said recess comprising a pocket arranged between said legs of said receiving part for receiving said clamping piece, each of said legs being provided with an equal number of threaded bores, a respective adjustment screw being held in a threaded bore in each of said legs.

3. A combination according to claim 2, in which said pocket is in the form of a slot closed on five sides.

4. A combination according to claim 2, in which said projections are distributed over the surfaces of said clamping piece.

5. A combination according to claim 4, in which said projections are knobs having a hemispherical shape.

6. A combination according to claim 4, in which said projections are respectively located so as to be equally spaced from said bore of said clamping piece.

7. A combination according to claim 6, in which said projections are respectively arranged symmetrical to the axes of said bore of said clamping piece.

8. A combination according to claim 7, in which said projections on the edges of said clamping piece are embodied as nose-shaped beads and have a semi-circular end edge.

9. A combination according to claim 8, in which said beads extend on all sides of said clamping piece.

10. A combination according to claim 8, in which said beads extend symmetrical to the middle axes of said clamping pieces.

11. A combination according to claim 10, in which the thickness of said beads 16 is less than the thickness of said clamping piece.

12. A combination according to claim 8, which includes two clamping pieces connected to one another to form a double embodiment, and which includes an area of reduced material thickness between said two clamping pieces for effecting said connection thereof and for attaining flexibility.

* * * * *